US006804365B2

(12) United States Patent
Ohira et al.

(10) Patent No.: US 6,804,365 B2
(45) Date of Patent: Oct. 12, 2004

(54) SPEAKER AND SPEAKER SYSTEM

(75) Inventors: Tatsuhiro Ohira, Kanagawa (JP); Yasuo Satoh, Kanagawa (JP); Hiroyuki Yoshii, Nara (JP); Kaoru Shimamura, Tokyo (JP); Kunio Kosaka, Kanagawa (JP); Yutaka Kobayashi, Kanagawa (JP)

(73) Assignees: Fujitsu Limited, Kanagawa (JP); Timedomain Corporation, Nara (JP); Authentic, Ltd., Kanagawa (JP)

( * ) Notice: Subject to any disclaimer, the term of this patent is extended or adjusted under 35 U.S.C. 154(b) by 78 days.

(21) Appl. No.: 10/075,114

(22) Filed: Feb. 13, 2002

(65) Prior Publication Data

US 2002/0114485 A1 Aug. 22, 2002

(30) Foreign Application Priority Data

Feb. 14, 2001 (JP) ..... 2001-036615

(51) Int. Cl.[7] ..... H04R 25/00
(52) U.S. Cl. ..... 381/386
(58) Field of Search ..... 381/87, 345, 386, 381/390, 396, 333–336, 388–389, 301–302, 353

(56) References Cited

U.S. PATENT DOCUMENTS

| | | | | | |
|---|---|---|---|---|---|
| 1,778,693 | A | * | 10/1930 | Semple, Jr. | 181/171 |
| 4,847,907 | A | * | 7/1989 | Ando | 381/86 |
| 4,939,783 | A | * | 7/1990 | Dunning | 381/386 |
| 5,937,073 | A | * | 8/1999 | Van Gieson | 381/391 |
| 6,377,696 | B1 | * | 4/2002 | Nevill | 381/345 |
| 2001/0028724 | A1 | * | 10/2001 | Kowaki et al. | 381/349 |

* cited by examiner

*Primary Examiner*—Curtis Kuntz
*Assistant Examiner*—P. Dabney
(74) *Attorney, Agent, or Firm*—Carrier, Blackman & Associates, P.C.; Joseph P. Carrier; William D. Blackman

(57) ABSTRACT

A speaker includes a main speaker part, and a case for containing and holding the main speaker part therein. A peripheral portion of a front side of the main speaker part is attached to a peripheral portion of the case, surrounding a hole formed in a front side of the case by placing a gasket cushion between both peripheral portions. The speaker further includes an internal rod, attached to a rear side of the main speaker part, for functioning as an imaginary ground.

8 Claims, 3 Drawing Sheets

SPEAKER AND SPEAKER SYSTEM

BACKGROUND OF THE INVENTION

1. Field of the Invention

This invention relates in general to a speaker and to a speaker system, used as an acoustic output means in an acoustic system such as an audio-video system or multi-media system, and in particular to a speaker and a speaker system in which an imaginary ground point is formed in a case.

2. Discussion of Relevant Art

In general, a speaker used as an acoustic output means in an audio-video system or multi-media system comprises a main speaker part for generating sound, and a case for containing and holding the main speaker part inside. The case has a function for containing and holding the main speaker part, and for emitting the sound forward produced by the main part. It also has a function to protect the main speaker part from external force or dust to prevent mechanical or chemical damage.

In a traditional speaker of the prior art, a peripheral portion of a frame in the front side of the main part is fixed to a peripheral portion of the case surrounding a hole formed in the case, to allow the main part to be suspended in midair without any other suspending means.

If a vibration produced by the main part is allowed to transmit to the case, an undesired sound will be excited at a frequency of resonance of the case, to cause a degradation of the quality of sound radiated by the speaker. Such a degradation in the quality of sound is sometimes called a box-sounding. To avoid the box-sounding, it is necessary to prevent a transmission of a vibration from the main speaker part to the case. For this purpose, a countermeasure has been taken in which the peripheral portion of the frame of the main speaker part is attached to the peripheral portion of the case, surrounding the hole, by placing a cushion gasket means, such as foamed plastics, between both peripheral portions, to prevent a transmission of a sound or to attenuate a vibration.

However, the above said countermeasure has not been sufficient to suppress the box-sounding. Therefore, a new countermeasure has been proposed in which the main part is supported by a supporting means placed inside the box without making any contact with the case (Jitsu-kou-show 63-42770, Toku-kai-hei 7-212881). In addition, some devices have been made relating how to attach the main part to such supporting means (Toku-kai-hei 11-289588, Toku-kai-hei 11-355876).

However, the new countermeasure gives restriction to placement of the speaker, because a base of such supporting means must be placed or fixed on a desk or a table outside of the case. Therefore, it is not possible to suspend such a speaker in midair, or to attach such a speaker to a side wall of a case of various electronic components, such as a personal computer.

SUMMARY OF THE INVENTION

Accordingly, it is an object of the present invention to provide a speaker and a speaker system which is substantially free from box-sounding.

It is another object of the present invention to provide a new speaker system which has flexibility of placement.

These and other objects of the present invention are achieved by the speaker system of the present invention, as will be understood by a review of the following detailed description section.

DETAILED DESCRIPTION OF THE PREFERRED EMBODIMENTS

Figure 1:
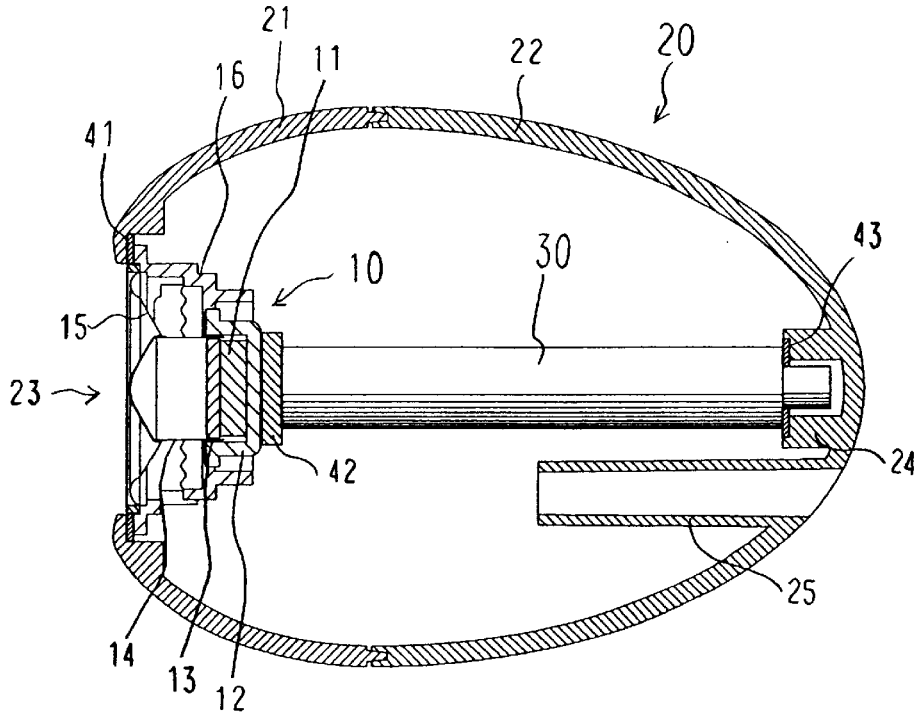
FIG. 1 is a cross-sectional view showing a speaker according to a first preferred embodiment of the present invention.
Figure 2:
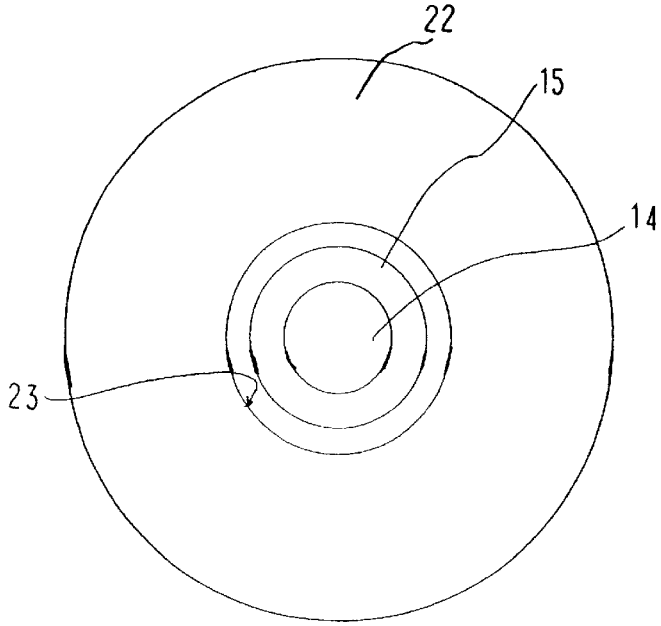
FIG. 2 is a front view of the speaker shown in FIG. 1.

In FIG. 1, a speaker according to a preferred embodiment of the invention is shown in a cross-sectional view. The front view of the speaker is shown in FIG. 2. The speaker comprises a main speaker part 10, a case 20 and a mass member or rod 30. The main speaker part 10 includes a magnet 11, a yoke 12, a voice coil 13, a bobbin 14, a vibration plate 15 comprising a cone and an edge, and a frame 16.

The case 20 has a shape of an egg shell, and is made from any appropriate plastics in which a front part 21 and a rear part 22 are combined. A peripheral portion of the frame 16 is attached to the peripheral portion of the case, surrounding a hole 23 formed in the case 20, by placing a soft cushion gasket 41 of a plastic foam by adhesion thereon.

The rod 30 is provided between the main speaker part 10 and the case 20 to form an imaginary ground, which functions similar to the ground as a support which makes only slight movement, as will be understood by reference to equations (1)–(3) below. The rod 30 is provided for adding mass to the fixed part of the main speaker part. The presence of the rod 30, as a backup to the main speaker part 10, significantly increases the effective inertia of the main speaker part.

The rod 30 is made from an alloy of steel, and has the shape of a cylindrical column or right cylinder. One tip surface of the rod 30 is firmly fixed to a plastic circular plate 42 by adhesion. The circular plate 42 is also fixed to a rear surface of the yoke 12, of the main speaker part 10, by adhesion. A socket 24 is formed on an inner surface of the casing rear part 22, to face the hole 23 formed on the front part of the case 20. The socket 24 has a shape of a column and has a shallow recess on the tip surface thereof.

Another tip portion of the rod 30 has a reduced diameter portion, to be inserted inside the socket 24. Another tip surface of the portion of the original diameter is attached and fixed to the recess of the socket 24 by adhesion by placing a soft cushion gasket 43 of plastic foam. A pipe 25, also called a duct, is attached to the case 20 to conduct pressure inside the case 20 to the outside, to be fed back to the front part of the case 20 to adjust the acoustic characteristic of the speaker in the range of low frequency.

A moving part comprises the voice coil 13, the bobbin 14 and the vibration plate 15, and moves back and forth relative to a fixed part, which comprises the magnet 11, the yoke 12, and the frame 16. The fixed part has a major part of the total mass of the main speaker part 10. The fixed part moves back and forth by reaction force caused by the movement of the moving part. However, an amplitude of the vibration of the fixed part will be smaller than that of the moving part, because the mass of the fixed part is larger than that of the moving part. Further, excess mass is added to the fixed part by attaching the heavy rod 30 to the fixed part, to increase inertia of the assembled fixed part, to reduce the amplitude of the vibration.

Assuming the mass of the fixed part of the main speaker part 10 to be m and the mass of the rod 30 to be M, respectively, the amplitude of the vibration of the fixed part will be $a=a_0 \sin \omega t$, and kinetic energy of the fixed part will be E $$E=((m+M)/2)(da/dt)^2=[(m+M)\omega^2 a_0^2/2](\cos \omega t)^2 \quad (1)$$

Assuming the maximum value of the kinetic energy to be $E_{max}$, $$E_{max}=((m+M)w^2 a_0^2 \quad (2)$$

$$a_0=(1/2\pi f)[E_{max}/m+M)]^{1/2} \quad (3)$$

$E_{max}$ in the equation (3) is a value determined by the output power of the speaker.

The equation (3) shows that the amplitude of the vibration of the fixed part of the main speaker part 10 can be effectively suppressed by adding the mass of the rod 30 to the fixed part of the main speaker part.

Thus the rod 30 works to prevent or minimize a generation of a vibration which will be transmitted to the case 20. The rod 30 can also be said to be an imaginary ground which is substantially immovable relative to the case 20, and to which the main speaker part is attached. The rod 30 works more efficiently as its mass increases. However, if the mass of the rod 30 becomes too large, it becomes difficult to support the rod 30 between the main speaker part 10 and the case 20. In considering these factors, the mass of the rod 30 may be chosen to become, at least, larger than the mass of the main speaker part 10, and preferably three to four times larger than that of the main speaker part 10, for a small speaker having output power of few watts.

The shape of the case 20 is preferably selected to be that of an egg shell, to prevent the internal walls opposing each other in parallel. As a result, standing waves, which would otherwise be formed between parallel walls, can not be formed inside the egg-shaped case 20, to prevent the box-sounding more effectively.

Figure 3:
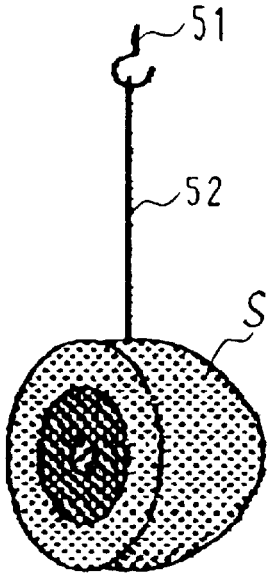
FIG. 3 is a perspective view showing one embodiment of a speaker system according to the present invention, comprising the speaker S in FIG. 1 and a supporting means.

FIG. 3 is a perspective view showing one embodiment of a speaker system according to the present invention. The speaker system comprises the speaker S of FIG. 1, and supporting means for supporting the speaker S. The supporting means comprises a hook 51, which may be attached to the ceiling, and a string 52 for suspending the speaker S from the ceiling. The string 52 can be replaced by a wire or a thin stick.

Figure 4:
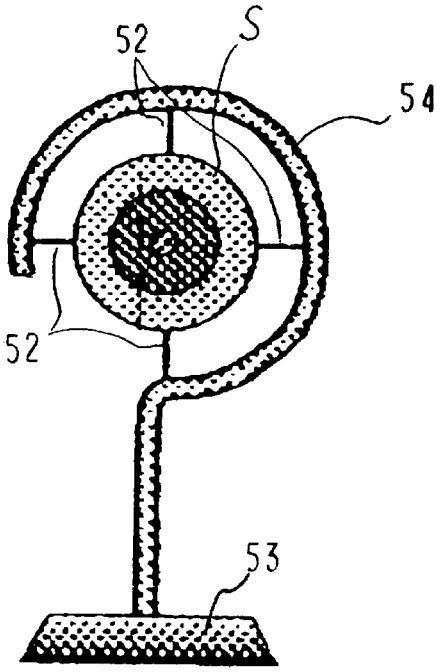
FIG. 4 is a front view showing another embodiment of the speaker system of the present invention.

FIG. 4 is a front view showing another embodiment of a speaker system according to the present invention. In the speaker system of FIG. 4, a supporting means comprises a base plate 53, a frame 54 having a base portion attached to the base plate 53, a tip side portion bent circularly, and four strings 52. The four strings 52 are provided for connecting four portions, on the outer surface of the case of the speaker S, to four fixing means placed on the bent portion of the frame 54. The strings 52 can be replaced by thin sticks or by wires.

Figure 5:
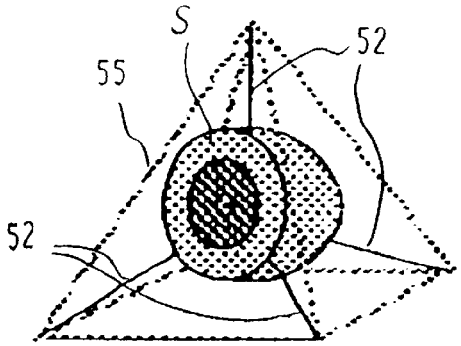
FIG. 5 is a perspective view showing another embodiment of the speaker system of the present invention.

FIG. 5 is a perspective view showing another embodiment of a speaker system according to the present invention. In the system of FIG. 5, the supporting means comprises a frame 55, formed in a shape of a pyramid having eight side edges formed from thin metal wire, and five strings 52 extending from five apexes. Once again, wires or sticks may be substituted for the strings 52, as desired.

Figure 6:
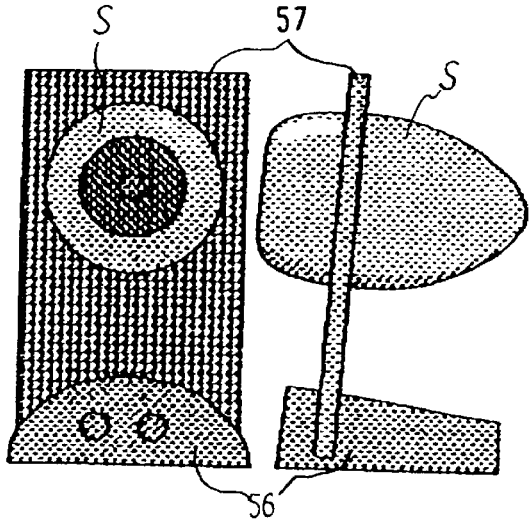
FIG. 6 is a front view and a side view showing still another embodiment of the speaker system of the present invention.

FIG. 6 is a front view and a side view showing another embodiment of the speaker system of the present invention. In the system of FIG. 6, the supporting means comprises a base 56 and a plate 57. The plate 57 is supported by the base 56 and extended upward from the base 56 almost perpendicularly. The speaker S is supported by the plate 57 by inserting it into a hole formed on the plate 57. The plate 57 may be any appropriate one including a side wall of the case for various electronic devices, for example a personal computer. The case of the speaker S is supported preferably at a nodal line of the vibration, which may be on the surface of the case of the speaker S. It may also be useful to place vibration-proof rubber, foam rubber, jelly, liquid or air between the speaker S and the plate 57, to attenuate the vibration transmitted inside, or to prevent a transmission of the vibration between them.

Figure 7:
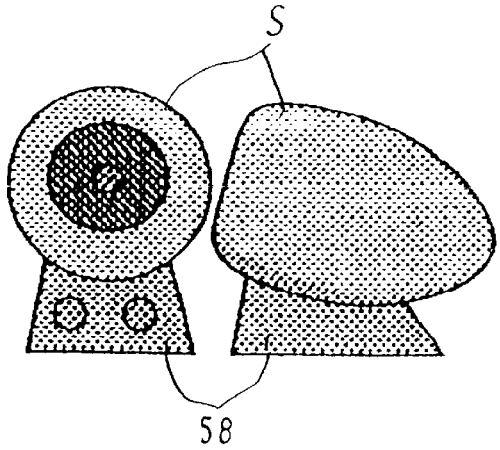
FIG. 7 is a front view and a side view showing a further embodiment of the speaker system of the present invention.

FIG. 7 is a front view and side view showing another embodiment of the speaker system of the present invention. In the speaker system of FIG. 7, the supporting means comprises a pedestal 58. The bottom surface of the speaker case is attached to the pedestal 58 by adhesion. The speaker S is set to point slightly upward to avoid a degradation of the quality of the acoustic characteristic thereof, which may be caused by a reflection from a plane on which the pedestal 58 is placed. Although the present invention has been described herein with respect to a preferred embodiment thereof, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. A speaker, comprising:

a main speaker part;

a case for containing and holding said main speaker part therein; and a mass member having one end portion attached to a rear portion of said main speaker part, and having another end portion attached flexibly to an inner wall of a rear portion of said case by placing a first cushion material between them;

said main speaker part comprising a peripheral portion of a front side attached flexibly to a peripheral portion of an aperture formed in a front portion of said case by placing a second cushion material between them; and said mass member having mass of more than that of said main speaker part for sufficiently reducing a level of vibration of said rear portion of said main speaker part to be transmitted to said case.

2. A speaker as claimed in claim 1, wherein:

said second cushion material is a gasket cushion.

3. A speaker as claimed in claim 1, wherein:

said mass member is a rod.

4. A speaker as claimed in claim 3, wherein:

said first cushion material is a gasket cushion.

5. A speaker as claimed in claim 1, wherein:

said case comprises a curved inner surface for substantially preventing generation of standing waves.

6. A speaker as claimed in claim 5, wherein:

said curved surface is part of a shape resembling an egg shell, a cylinder, a cocoon, or a peanut.

7. A speaker, comprising:

a main speaker part;

a case for containing and holding said main speaker part therein; and a mass member having one end portion connected to a rear portion of said main speaker part;

said main speaker part comprising a peripheral portion of a front side attached flexibly to a peripheral portion of an aperture formed in a front portion of said case by placing a cushion material between them; and said mass member having three to four times as much mass as said main speaker part sufficiently reducing a level of vibration of said rear portion of said main speaker part to be transmitted to said case.

8. A speaker assembly, comprising:

a) a casing comprising a curved inner surface for minimizing generation of standing waves, said casing having a front portin with a hole formed therein and a rear portion opposite said hole;

b) a main speaker part comprising:

a fixed part comprising a frame and a magnet, and a movable part comprising a voice coil and a vibration plate;

said main speaker part having a rear surface and being operatively attached to said casing adjacent said hole; and c) a mass member situated within the casing, said mass member interconnecting said rear surface of said main speaker part with said rear part of said casing, and said mass member providing a substantially inflexible substrate for resisting vibration of the fixed part of said main speaker part; and wherein said mass member has three to four times as much mass as said main speaker part.

* * * * *

UNITED STATES PATENT AND TRADEMARK OFFICE

CERTIFICATE OF CORRECTION

PATENT NO. : 6,804,365 B2
DATED : October 12, 2004
INVENTOR(S) : Ohira et al.

It is certified that error appears in the above-identified patent and that said Letters Patent is hereby corrected as shown below:

Column 3,
Line 24, change Equation (2) from "$E_{MAX}=((m+M)w^2a_o^2$" to -- $E_{MAX}=(m+M)\omega^2 a_o^2$ --;
Line 26, please change Equation (3) from "$a_o=(½\pi f)[E_{MAX}/m+M)]½$" to -- $a_o=(½\pi f)[E_{MAX}/(m+M)]^{½}$ --.

Signed and Sealed this

Twenty-fifth Day of January, 2005

JON W. DUDAS
*Director of the United States Patent and Trademark Office*